United States Patent [19]

Trafton

[11] 4,194,338

[45] Mar. 25, 1980

[54] CONSTRUCTION COMPONENTS, ASSEMBLIES THEREOF, AND METHODS OF MAKING AND USING SAME

[76] Inventor: Ronald H. Trafton, 527 Berry Patch La., Pontiac, Mich. 48054

[21] Appl. No.: 972,394

[22] Filed: Dec. 22, 1978

Related U.S. Application Data

[63] Continuation-in-part of Ser. No. 835,008, Sep. 20, 1977, Pat. No. 4,142,343.

[51] Int. Cl.[2] ..... E04C 3/32

[52] U.S. Cl. ..... 52/721; 52/738; 256/65

[58] Field of Search ..... 52/721, 737, 738, 730; 256/59, 65

[56] References Cited

U.S. PATENT DOCUMENTS

| | | | |
|---|---|---|---|
| 3,160,249 | 12/1964 | Pavlecka | 52/738 |
| 3,520,663 | 7/1970 | Schertel | 52/738 |
| 4,142,343 | 3/1979 | Trafton | 52/721 |

*Primary Examiner*—James L. Ridgill, Jr.

*Attorney, Agent, or Firm*—Irving M. Weiner; Pamela S. Burt; Melvin Yedlin

[57] ABSTRACT

A maintenance-free post or building structural member having longitudinal grooves therein for mating with complementary brackets, which brackets are also adapted to mate with other building structural members, and end-adapters for mounting such posts and for connecting one post to other such posts at predetermined angles. The post is hollow and has a constant wall thickness. Each groove has a curved portion and a flat portion. The brackets may be moved in the grooves adjustably, and may be locked to the post without causing any deformation of the post or bracket.

10 Claims, 31 Drawing Figures

CONSTRUCTION COMPONENTS, ASSEMBLIES THEREOF, AND METHODS OF MAKING AND USING SAME

CROSS-REFERENCE to RELATED APPLICATION

This application is a continuation-in-part of U.S. patent application Ser. No. 835,008 filed Sept. 20, 1977 now U.S. Pat. No. 4,142,343, issued Mar. 6, 1979.

BACKGROUND OF THE INVENTION

1. Field of the Invention

The present invention relates generally to construction components for buildings, and to methods of constructing and utilizing such construction components.

In particular, the present invention relates to an extruded aluminum post having a tubular configuration with a substantially constant wall thickness, and a plurality of longitudinal grooves in its outer periphery wherein each groove has an arcuate wall portion and an intersecting substantially flat wall portion, adapted to retain mating brackets, and end-adapters for mounting such posts and for interconnection of posts.

2. Description of the Prior Art

Heretofore, posts and support assemblies for privacy fences, boat docks, cyclone fencing, highway signs, and the like, have utilized various devices which are cumbersome, and require relatively frequent maintenance and replacement. While it has been recognized that metallic posts avoid some of the wear and deteriorating properties of wooden posts, special attachments and hardware requirements of suggested metal posts have slowed the use of such posts in the applications mentioned hereinbelow.

Various prior art attempts to solve or meliorate the aforementioned problems have proven unsuccessful. The prior art attempts are exemplified by the inventions disclosed in Moore U.S. Pat. No. 3,398,499; Cheslock U.S. Pat. No. 3,462,110; Kiefer U.S. Pat. No. 3,728,837; and U.S. Pat. No. 4,021,973.

The present invention solves the aforementioned problems in a convenient and relatively inexpensive manner, and also provides various adapters, connectors and brackets enabling utilization of such posts as structural load-bearing members for use in structures such as buildings.

SUMMARY OF THE INVENTION

The present invention provides a post apparatus which includes an elongated support member having a major longitudinal central axis and an outer periphery which includes at least one groove therein. The elongated support member has a tubular configuration which has a substantially constant wall thickness. A groove is disposed substantially parallel to the major longitudinal central axis of the elongated support member, and the groove has an arcuate side wall portion and a substantially flat side wall portion. The groove includes a flat base portion which is disposed in a flat plane that is oriented substantially perpendicular to a radius emanating from the major longitudinal central axis of the elongated support member. The apparatus further includes interconnecting means for assembling a plurality of the elongated support members into a building frame structure.

The present invention also provides a novel method of constructing and utilizing the aforementioned apparatus.

It is an object of the invention to provide a maintenance-free anodized aluminum post structure with complementary mating brackets therefor.

Another object of the present invention is to provide an improved support arrangement for adjustably and releasably supporting a bracket member or the like from a vertically extending support pole member.

A further object of the invention is to provide a fence post having an auger or drive point at the bottom thereof for rotating the post into frozen or hard terrain, or driving the post into softer terrain.

An additional object of the invention is to provide an extruded tubular post support member having a substantially constant wall thickness.

A further object of the present invention is to provide a post apparatus having grooves provided with novel re-entry sections facilitating manufacture thereof and ease of adjustably securing therein external bracket members.

Yet a further object of the invention is to provide a post support apparatus which is simply constructed and pleasing in appearance, and which is especially suited for connecting signs and the like, as well as for interconnection to conventional building structural members.

An additional object of the invention is to provide a metallic post support member wherein brackets are interlocked therewith without the necessity of deforming either the post or the bracket, and without the necessity of the heads of any bolts entering any of the grooves of the post.

Another object of the invention is to provide novel bracket members which may be interchangeably used on posts having different configurations and groove arrangements.

Another object of the invention is to provide novel adapter members for mounting and interconnecting such posts.

The foregoing and other objects and advantages of the present invention will become apparent from the ensuing disclosure in which several preferred embodiments of the invention are described in detail and illustrated in the accompanying drawings wherein like parts are designated by like reference numerals. It is contemplated that minor variations in structural features and arrangement of parts thereof may occur to the skilled artisan without departing from the spirit of the present invention and without sacrificing any of the advantages or objects of the present invention.

DETAILED DESCRIPTION

Before explaining the present invention in detail, it is to be understood that the present invention is not limited in its application to the details of construction and arrangement of parts as illustrated in the accompanying drawings, because the present invention is capable of other embodiments and of being practiced or carried out in various other ways. In addition, it is to be understood that the phraseology and terminology employed herein is for the purpose of description and illustration only, and not for the purpose of restriction or limitation.

Figure 1:
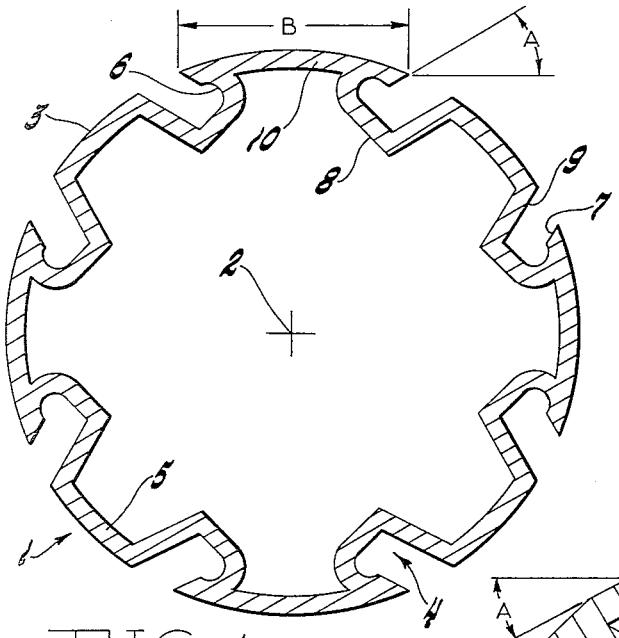
FIG. 1 illustrates a cross-sectional view of a post in accordance with a first possible embodiment of the present invention.

With reference to FIG. 1, there is shown in cross-section an elongated support member or post 1 having a major longitudinal central axis 2 and an outer periphery 3 which includes one or more grooves 4 therein. The post 1 has a tubular configuration, with a wall 5 of substantially constant thickness.

Each of the grooves 4 is disposed substantially parallel to the central axis 2. Each groove 4 has an arcuate wall portion 6 and a substantially flat wall portion 7. The wall portion 7 is disposed in a plane which is oriented askew with respect to the axis 2. In other words, flat wall portion 7 is disposed in a plane to one side of the axis 2, and which does not intersect with axis 2. In particular, it should be noted that the first flat wall portion 7 is constructed to be oriented in a predetermined angle A. In a particular working embodiment of the invention the predetermined angle A has been fixed at approximately 30°.

The groove 4 further includes a base portion or base 8 which is disposed in a plane that is oriented substantially perpendicular to a radius emanating from axis 2. It should be noted that no surface or wall portion of the groove 4 is disposed substantially perpendicular to the plane within which the base 8 of that groove is disposed. It should also be noted that the arcuate wall portion 6 intersects the first flat wall portion 7 in an oblique dihedral angle.

Each groove 4 also includes a second substantially flat wall portion 9 which is disposed opposed to and substantially parallel to the first flat wall portion 7. The second flat wall portion 9 intersects the base 8 in an oblique dihedral angle. Although first flat wall portion 7 is parallel to second flat wall portion 9, wall portion 7 does not intersect base 8, but rather wall portion 7 is separated from base 8 by arcuate wall portion 6. However, because of the parallel arrangement of flat wall portions 7 and 9, wall portion 7 is disposed in a plane which would intersect base 8 in a similar oblique dihedral angle.

Bases 8, and geometric extensions thereof, geometrically define the outline of a square. The function of this configuration w'll become apparent from the description which follows.

The configuration and dimensions of post 1 are critical to operability and interchangeability of the various components of the present invention. In this connection, attention is directed to the predetermined dimension B of an arcuate wall section 10 forming part of the outer periphery 3 of the post 1. The significance of dimension B of section 10 will become more apparent from the explanation set forth hereinbelow.

Figure 2:
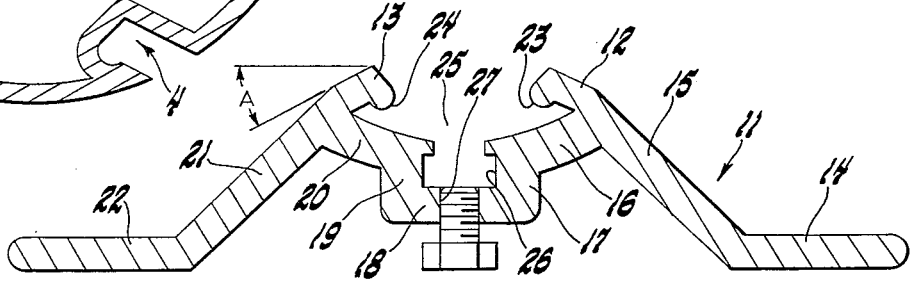
FIG. 2 illustrates a cross-sectional view of a bracket member for mating and interlocking with the post depicted in FIG. 1.

FIG. 2 depicts in cross-section a first bracket member or bracket 11 for mating with and interconnection with the post 1. Bracket 11 has a first arm 12 which is shaped and dimensioned to fit within a groove 4 of the post 1. Bracket 11 also has a second arm 13 configured and dimensioned to fit within another groove 4 so that arms 12 and 13 fit within adjacent grooves 4 separated by a wall section 10. Arms 12 and 13 are oriented to converge toward each other.

Bracket 11 includes straight members 14, 15, 17, 18, 19, 21 and 22, arms 12 and 13, and arcuate members 16 and 20. The arms 12 and 13 and the arcuate members 16 and 20 are configured and dimensioned to permit a wall section 10 of post 1 to fit therewithin in order to assemble post 1 and bracket 11. The arcuate space 25 formed in bracket 11 is also formed in part by arcuate portions 23 and 24 at the ends of arms 12 and 13, respectively. The radius of curvature of arcuate portions 23 and 24 is slightly smaller than the radius of curvature of arcuate wall portion 6 of the grooves 4.

As shown in FIG. 2, members 15 and 21 are not coplanar with arms 12 and 13, respectively. Arms 12 and 13 have a separate angular orientation with respect to members 15 and 21, respectively, in order to assure that arms 12 and 13 are oriented to present the same predetermined angle A which is indicated in FIGS. 1 and 2.

Also as shown in FIG. 2, a box-like cavity 26 is formed between members 17, 18 and 19. Member 18 is provided with an unthreaded hole therethrough which communicates with cavity 26. A bolt (not shown) may be passed through hole 27 to threadedly engage with a nut (not shown) disposed in cavity 26 to rigidly secure bracket 11 to post 1. By tightening the bolt, the end of the bolt would bear against the wall section 10 of post 1. As an alternative, in order to eliminate the need for the nut or the formation of cavity 26, there could be provided a threaded hole (such as the one described hereinbelow in connection with FIG. 5) in a continuous arcuate member in lieu of the discontinuous arcuate members 16 and 20.

Figure 3:
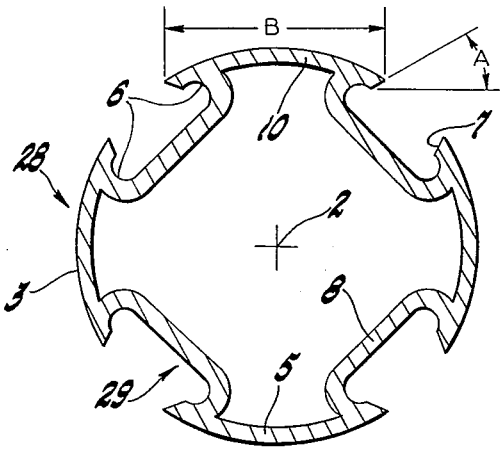
FIG. 3 illustrates a cross-sectional view of a post in accordance with a second possible embodiment of the present invention.

FIG. 3 shows a modified post 28 having grooves 29 which are larger than and configured somewhat differently than grooves 4 of post 1. Groove 29 does not have any second flat wall portion 9 such as in groove 4, but groove 29 does have a larger base 8 and diametrically-opposed and oppositely-facing arcuate wall portions 6. The radii of curvature of arcuate portion 6, the predetermined dimension B, and the angular orientation of flat surface 7 in predetermined angle A are identical for posts 1 and 28. The purpose of having posts 1 and 28 configured in this somewhat similar fashion is to permit the bracket 11 to be used interchangeably as desired for post 1 or post 28.

As in post 1, base portions 8 define the outline of a square.

Figure 4:
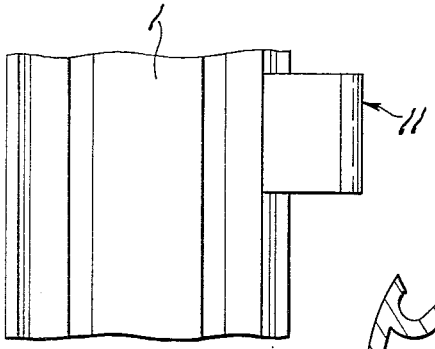
FIG. 4 illustrates a partial elevational view of an assembled bracket and post apparatus in accordance with the present invention.

FIG. 4 shows an elevational view of bracket 11 secured to post 1 (or post 28).

Figure 5:
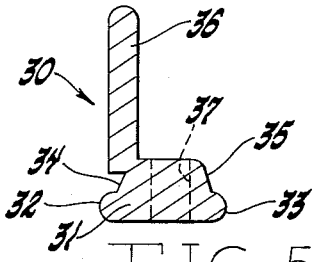
FIG. 5 illustrates a cross-sectional view of a modification of the bracket member.

FIG. 5 shows a second bracket member or bracket 30 for mating with and interconnecting with post 28 by fitting within and occupying substantially the entire space of a groove 29 on post 28. Bracket 30 has a first portion 31 which is configured and dimensioned to fit within groove 29 of post 28. First portion 31 has diametrically-opposed and oppositely-facing arcuate surfaces 32 and 33 each of which conforms substantially to the shape of the arcuate wall portions 6 of groove 29.

First portion 31 is also provided with angled surfaces 34 and 35 which conform to the angular orientation of first flat wall portions 7 of groove 29. First portion 31 is integrally connected with lateral member 36 of bracket 30. Member 36 may be connected to or form part of a fence, wall, sign, etc. A threaded aperture 37 extends through first portion 31 for accommodating a threaded bolt (not shown) for securing bracket 30 to post 28.

Figure 6:
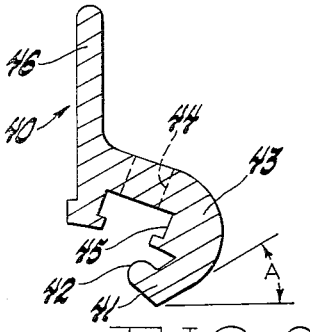
FIG. 6 depicts a cross-sectional view of a further modified bracket member.
Figure 7:
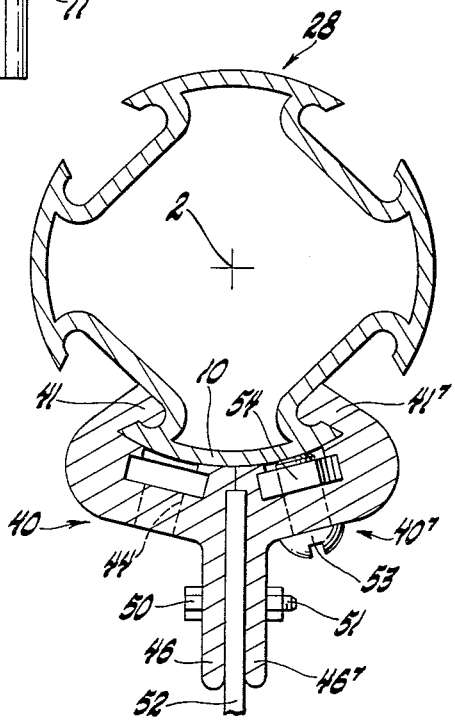
FIG. 7 illustrates a cross-sectional view of an assembly of the FIG. 3 post interconnected to a perpendicularly disposed external member by means of two FIG. 6 brackets.

FIGS. 6 and 7 show a modified third bracket member or bracket 40 for mating with post 1 or 28. Bracket 40 has an arm 41 with an arcuate portion 42 which is configured and dimensioned similar to arm 13 and arcuate portion 24 of bracket 11.

Arm 41 is unitary with a second portion 43 having an unthreaded aperture 44 therethrough and a cavity 45 formed therewithin, similar to the hole 27 and cavity 26 of bracket 11. Portion 43 is unitary and integral with a lateral portion 46 of bracket 40.

FIG. 7 shows a pair of brackets 40 and 40′ which may be welded, or bolted by bolt 50 and nut 51, to a member 52, such as for example a sign, wall, board, metal plate, etc. The brackets 40 and 40′ having the member 52 sandwiched therebetween are shown assembled on and secured to post 28 by means of suitable fastening means, such as a pair of bolts 53 and nuts 54 (only one of each of which is shown).

Figure 8:
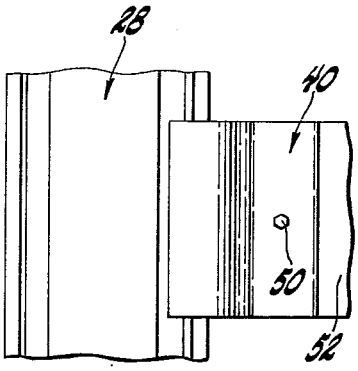
FIG. 8 illustrates a partial elevational view of the FIG. 7 assembly.

FIG. 8 is an elevational view of the FIG. 7 apparatus as assembled.

It should be borne in mind that the brackets 40 and 40′ can be employed for use with either post 28 or post 1.

It should also be borne in mind that the particular dimensions and configurations of the apparatus components described hereinabove are of particular importance to the ease of manufacturing of such components, and also to the adjustability and assembly of the various components.

It should be noted that the bracket 11 permits the securement of planar members which are either extensions of members 14 and 22 or coplanar therewith, and whereby the post 1 or 28 used therewith is substantially tangent to such coplanar members.

On the other hand, brackets 40 and 40′ permit the assembly of a planar member, such as a sign or wall or fence, which is substantially coplanar with the major longitudinal central axis 2 of post 1 or 28.

Bracket 30 permits the assembly of an extension of member 36 or a member coplanar therewith, with respect to a post 28 having its central axis 22 offset from member 36 or any member coplanar therewith.

The present invention also contemplates color coding the apparatus components mentioned hereinabove to coordinate with external members used therewith. For example, post 1 or 28 can be provided in a red color when used in conjunction with redwood boards for fencing or other purposes.

Figure 9:
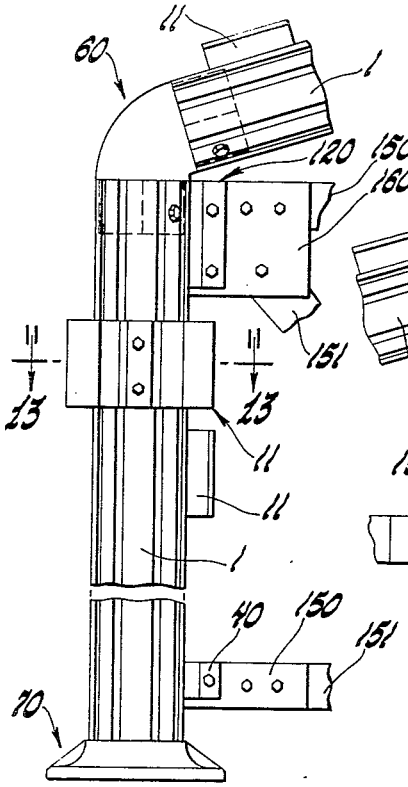
FIG. 9 illustrates an elevational view of an assembled bracket, adapter, connector, and post apparatus in accordance with the present invention, adapted for use as a building structural member.
Figure 25:
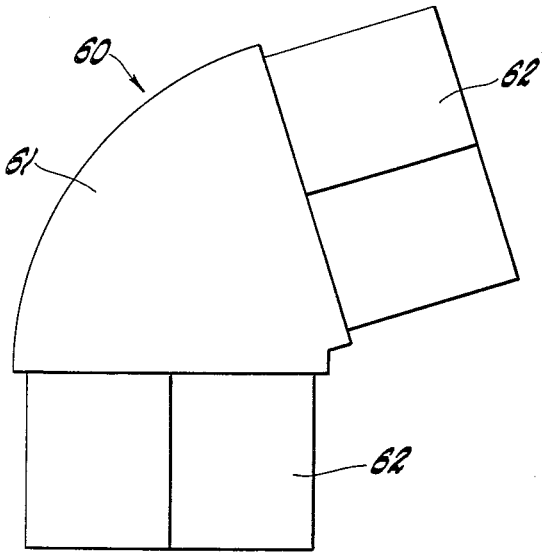
FIG. 25 illustrates a horizontal perspective view of a first embodiment of a connector according to the present invention.
Figure 26:
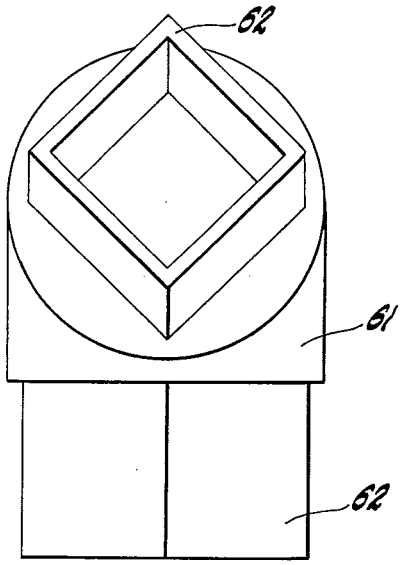
FIG. 26 illustrates a second horizontal perspective view of a connector according to FIG. 25.

FIG. 9 is a view of a post assembly configured as a side member of a building structure. In this illustration, a post 1, or 28, is fitted with an adapter 70 which can be fastened to a foundation member (not shown) in a conventional manner, such as with bolts and nuts. Adapter 70 is further described in FIGS. 23 and 24. At the upper end of post 1, a connector 60, further described in FIGS. 25 and 26, is interposed between the first post 1 and a second post 1, which is part of a roof truss assembly. Posts 1 may be bolted to connector 60, if desired. Brackets 11 serve as attachment points for roof and wall members (not shown). Brackets 40, and brackets 120 (described in FIGS. 16 and 17), serve as attachment points for other structural members, which may be adapter plates and steel L-shaped angle members. Plates 150 and 160 are interposed between brackets 120 and 40 and angle members 151, and connected thereto in a conventional manner.

Figure 10:
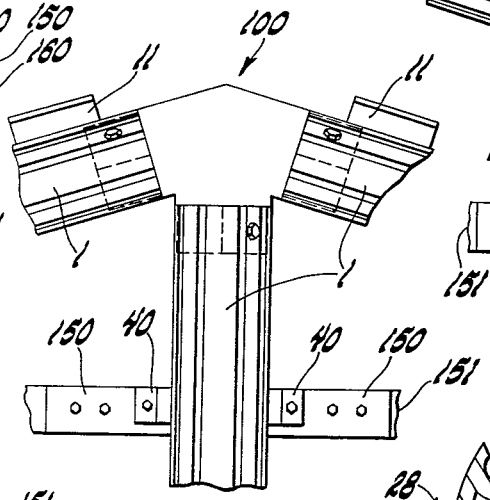
FIG. 10 illustrates a partial elevational view of an assembled bracket, connector and post assembly in accordance with the present invention, adapted for use as a building structural member, such as the center of a roof truss assembly.

FIG. 10 illustrates a connector 100 interposed among three posts 1, serving as the central peak portion of a roof truss assembly. Connector 100, further described in FIGS. 27 and 28, may be connected to posts 1 by conventional means, such as bolts, if desired. In the illustrated embodiment, brackets 40 and plates 150 connect one post 1 to angle members 151, and brackets 11 serve to attach roof members (not shown).

Figure 11:
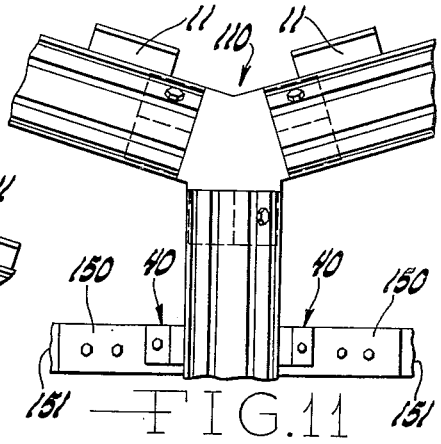
FIG. 11 illustrates a partial elevational view of an assembled bracket, connector and post assembly in accordance with the present invention, adapted for use as a building structural member, such as a connector between two roof truss assemblies.
Figure 29:
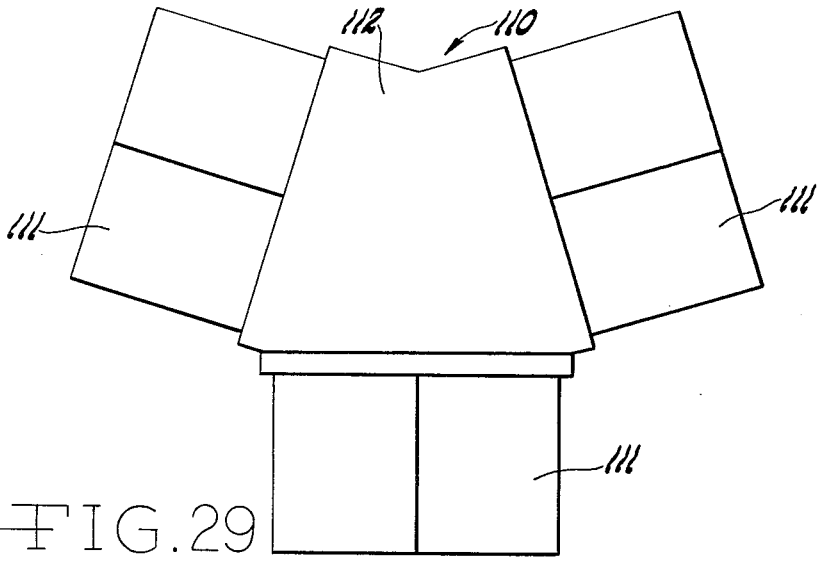
FIG. 29 illustrates a horizontal perspective view of a third embodiment of a connector according to the present invention.
Figure 30:
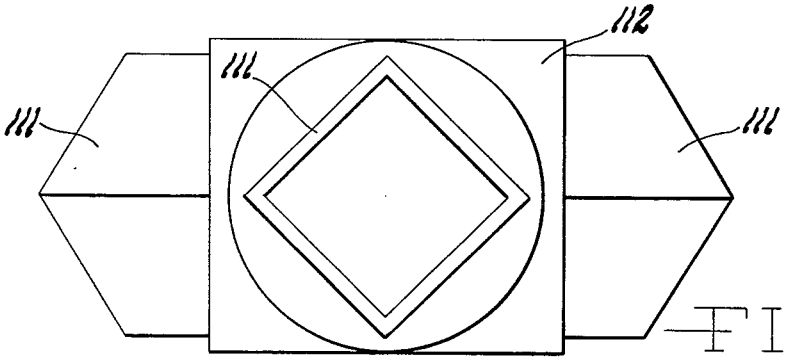
FIG. 30 illustrates a vertical perspective view of a connector according to FIG. 29.

FIG. 11 illustrates a connector 110, further described in FIGS. 29 and 30, interposed between posts 1, in a configuration that may be used to connect two roof truss assemblies to form a double-width building. As in the above, brackets 11 may serve to attach roof members, and brackets 40 and plates 150 attach angle members 151.

Figure 12:
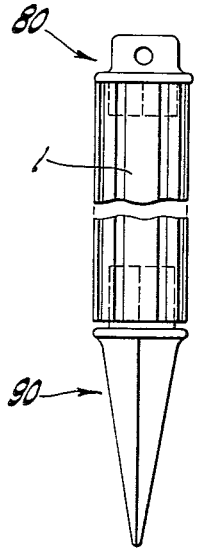
FIG. 12 illustrates an elevational view of a post and adapter assembly according to the present invention, adapted for driving one end of the post into soft terrain.

FIG. 12 illustrates a post 1 fitted with a drive cap 80 and a drive point 90, for inserting post 1 into relatively soft terrain. Cap 80 and point 90 are further described in FIGS. 21, 22 and 18.

Figure 13:
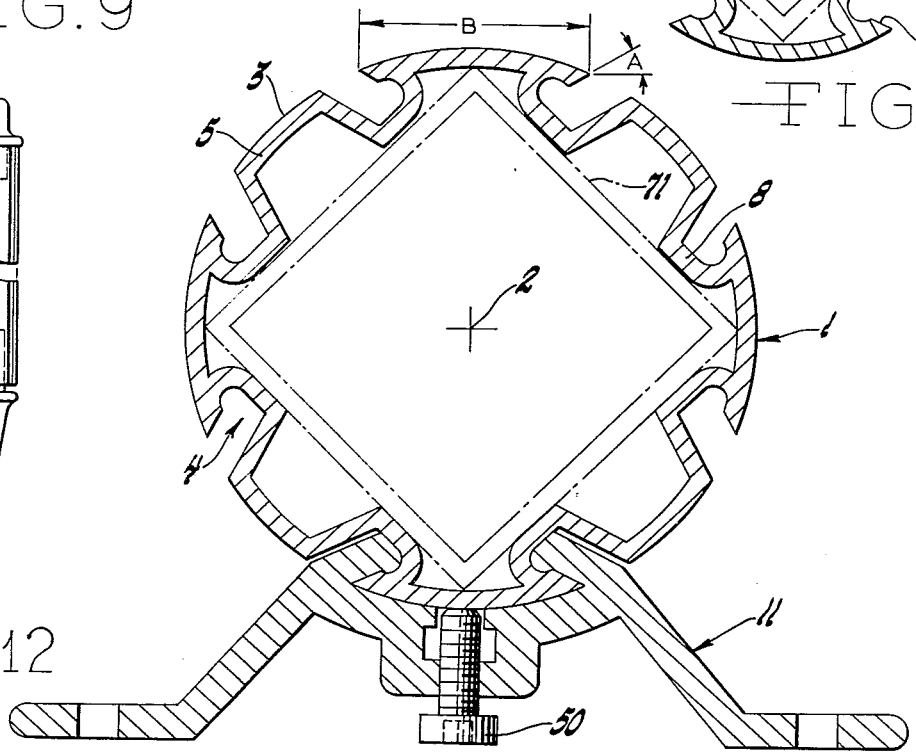
FIG. 13 illustrates a cross-sectional view of the assembly shown in FIG. 9.

FIG. 13 illustrates a vertical perspective cross-sectional view of FIG. 9, showing a bracket 11 attached to post 1, and showing particularly the manner in which post 1 is attached to adapter 70. As shown, square flange 71 of adapter 70 is inserted onto post 1, and contacts post 1 at base portions 8. From FIG. 13 it will be apparent that drive cap 80, drive point 90, auger point 120, and connectors 60, 100 and 110 attach to post 1 in a similar manner.

Figure 14:
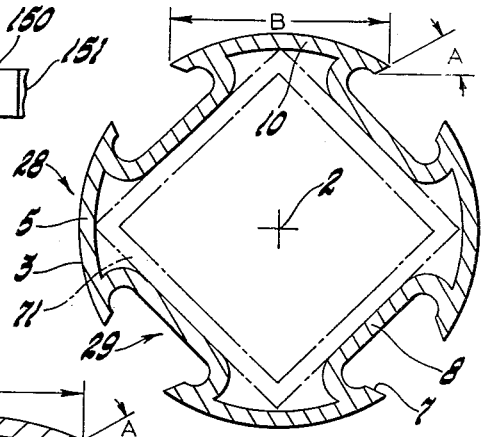
FIG. 14 illustrates a cross-sectional view of a post in accordance with a second possible embodiment of the present invention and an adapter or connector in accordance with the present invention.

FIG. 14 illustrates the manner in which a modified post 28 may be connected to flange 71 of an adapter 70, which also is typical of the manner of connecting a post 28 to a drive cap 80, drive point 90, auger point 120, or connectors 60, 100 and 110.

Figure 15:
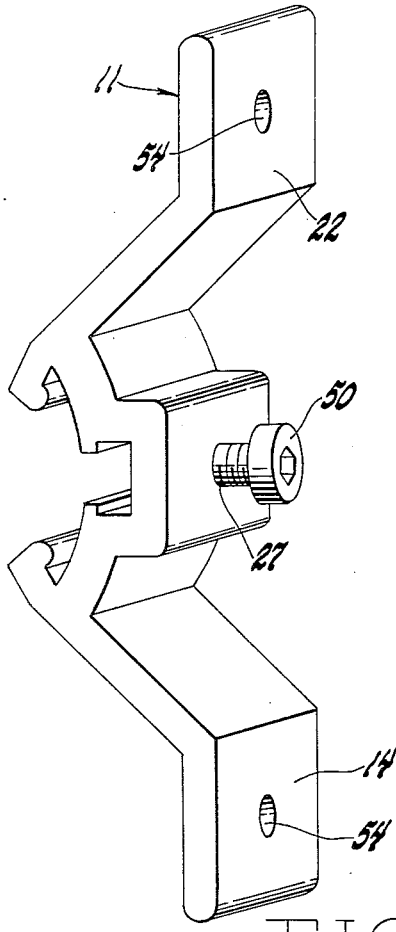
FIG. 15 illustrates a perspective view of one embodiment of a bracket according to FIG. 2.

FIG. 15 illustrates a perspective view of one embodiment of a bracket 11, having holes 54 in portions 14 and 22, and bolt 50 in hole 27. This figure is for illustration of the shortest possible embodiment of a bracket 11, since actual working embodiments vary in length as appropriate to support signs, and roof and wall members of buildings, and may have a plurality of holes 27 and 54, and bolts 50.

Figure 16:
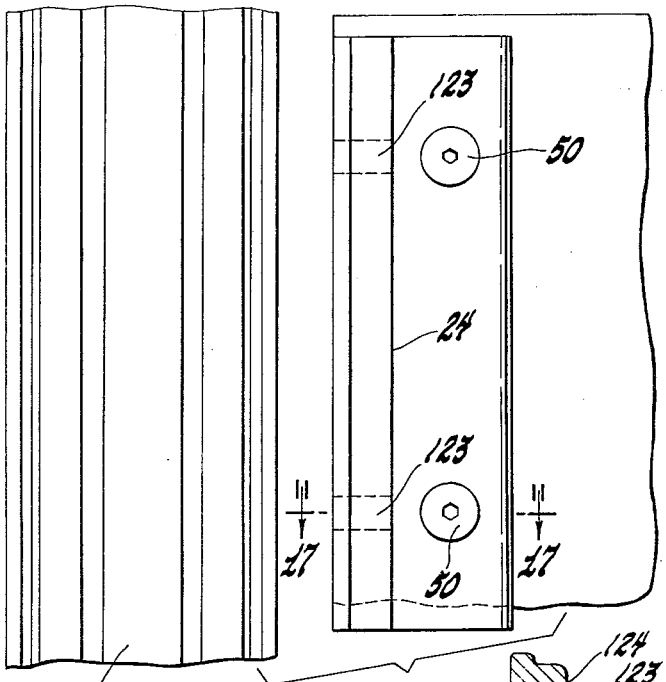
FIG. 16 illustrates a post and bracket assembly in accordance with the present invention, adapted for attaching a plurality of plate or bar members to the post.
Figure 17:
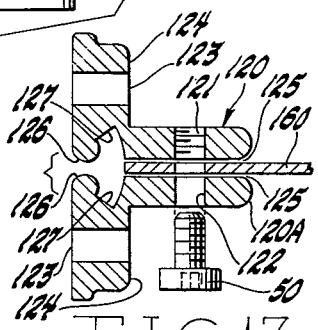
FIG. 17 illustrates a cross-sectional view of the bracket shown in FIG. 16.

FIGS. 16 and 17 illustrate the construction and use of a bracket 120 which is capable of attaching three members of the desired type to a common point on a post 1 or 28. As shown, symmetrical bracket portions 120 and 120*a* have surfaces 124 to which plate-shaped members can be attached by means of fasteners (not shown) passing through holes 123, and surfaces 125 which bear upon and retain a plate member 160.

As shown, bracket 120*a* has an unthreaded hole 122, and bracket 120 has a threaded hole 121, to retain bolt 50, although it is apparent that brackets 120 and 120*a* could be identical, and a nut could be used to retain bolt 50. Both brackets 120 and 120*a* have portions 126 and 127, which mate with portions 6 and 7, respectively, of a post 1 or 28.

Figure 18:
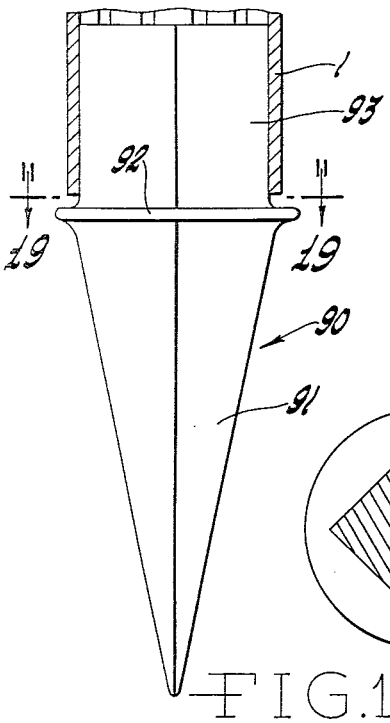
FIG. 18 illustrates a partial elevational view, partially in section, of a post fitted with a drive point according to the present invention.
Figure 19:
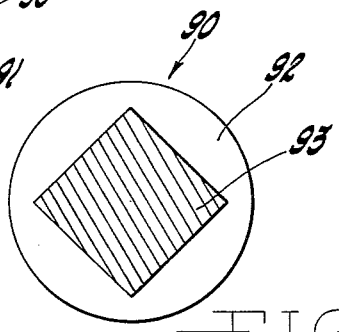
FIG. 19 is a cross-sectional view of FIG. 18.

FIGS. 18 and 19 illustrate drive point 90. Drive point 90 has a four sided pyramidal point 91, a flange portion 92, and a solid square connector portion 93, which fits into a post 1 or 28 in the manner described in connection with FIGS. 13 and 14. Connector portion 93, in an actual working embodiment, is an interference fit within a tube 1 or 28, and flange portion 92 is adapted to aid in removing drive point 90 from a post 1 or 28.

Figure 20:
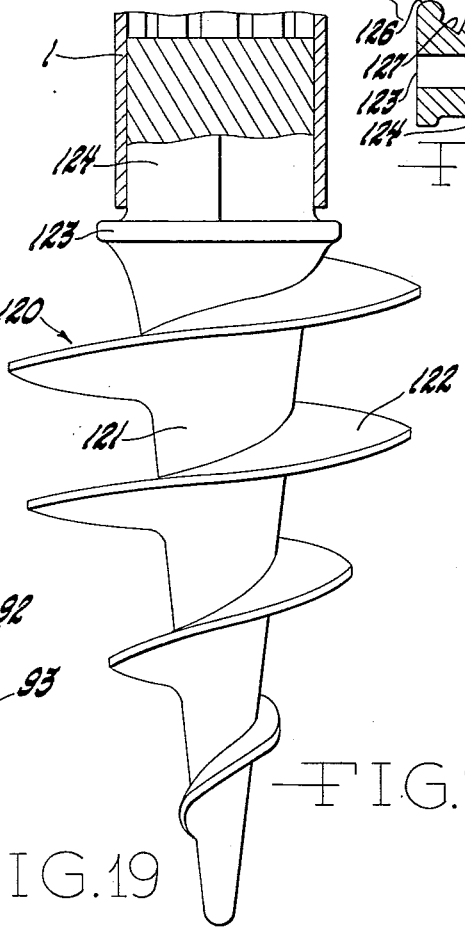
FIG. 20 illustrates an elevational view, partially in cross-section, of a post fitted with an auger point according to the present invention.

FIG. 20 illustrates the construction of drive auger 120, which, in an actual working embodiment, is used to removably emplace a post 1 or 28, for use with large signs and the like. Auger 120, in this embodiment, has cone portion 121, a helical screw portion 122, a flange portion 123, and a solid, square connector portion 124, identical to portion 93 of FIG. 19, which fits inside a post 1 or 28 as shown in FIGS. 13 and 14. In an actual working embodiment, portion 124 is an interference fit in a post 1 or 28, and flange 123 is adapted to aid in the removal of an auger 120 from a post 1 or 28.

Figure 21:
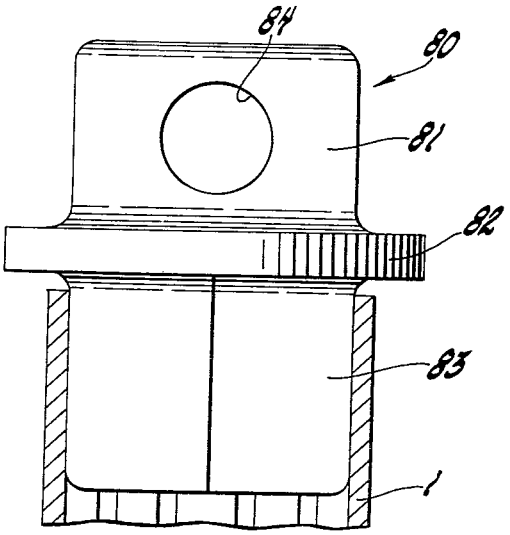
FIG. 21 illustrates an elevational view, partially in cross-section, of a post fitted with a first embodiment of a drive cap according to the present invention.
Figure 22:
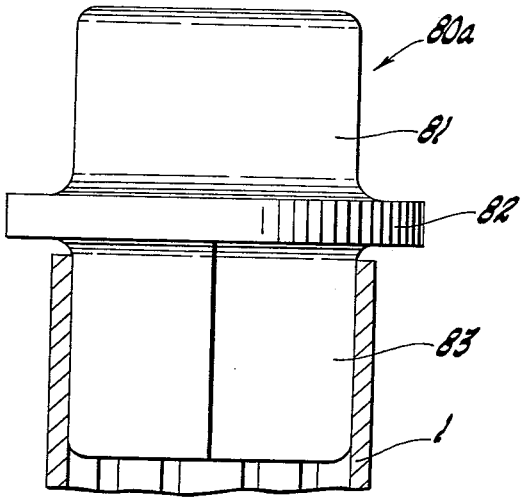
FIG. 22 illustrates an elevational view, partially in cross-section, of a post fitted with a second embodiment of a drive cap according to the present invention.

FIGS. 21 and 22 illustrate drive caps 80 and 80*a* according to the present invention. In this embodiment, drive caps 80 and 80*a* have solid, square connector portions 83, flange portions 82, and cylindrical drive portions 81. Actual physical embodiments of caps 80 and 80*a* differ in that cap 80 has transverse drive hole 84, and portion 83 is a loose fit within a post 1 or 28, while portion 83 of cap 80*a* is an interference fit in a post 1 or 28. In one actual application of the illustrated embodiment of this invention, an auger 120 and cap 80 are placed on opposite ends of a post 1, and a rod is used through hole 84 to drive auger 120 into the ground. Then cap 80 is removed and replaced with a cap 80*a*, which cannot be removed without tools, and, lacking a hole 84, prevents unauthorized removal of the post 1 or 28.

Figure 23:
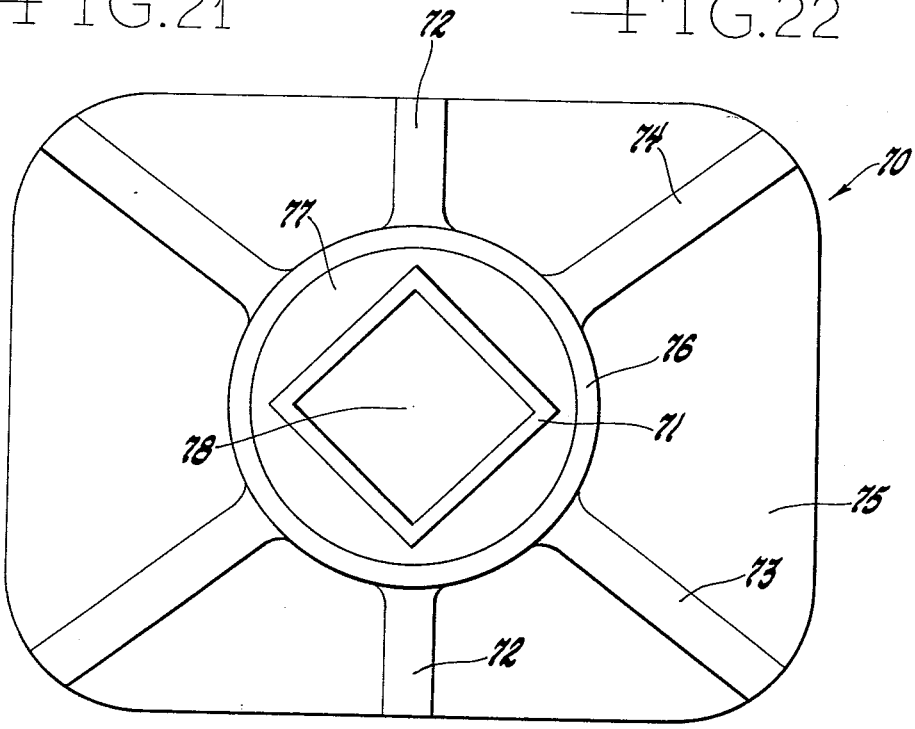
FIG. 23 illustrates a vertical perspective view of an adapter according to the present invention.
Figure 24:
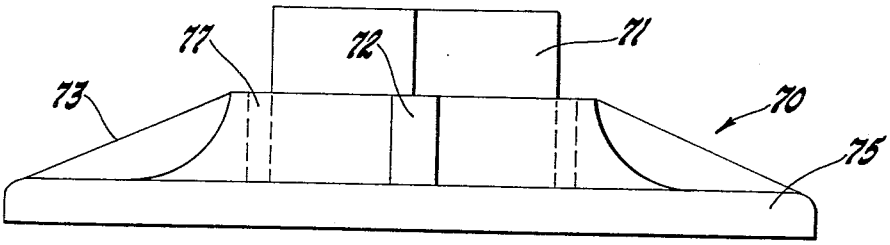
FIG. 24 illustrates a horizontal perspective view of an adapter according to the present invention.

FIGS. 23 and 24 illustrate the construction of an adapter 70. Adapter 70 has a base plate 75, which may be provided with apertures (not shown) to attach it to a surface (not shown) and is provided with ring portion 76, reinforced with buttresses 72 and 73, and square flange portion 71, adapted to fit within a post 1 or 28 in the manner shown in FIGS. 13 and 14. An end of a post 1 or 28 may be received into space 77, defined by base plate 75, ring portion 76, and flange portion 71.

In actual working physical embodiments of the invention, posts and brackets are extrusions, and all other components, such as adapters, connectors, caps, and drive or auger points, are made by casting.

FIGS. 25 and 26 illustrate an embodiment of a connector 60, adapted to connect two posts 1 or 28 together at a predetermined angle. In an actual physical embodiment, the predetermined angle is approximately 120 degrees, and the connector 60 is used to connect a vertical side member post to a post forming the upper edge of a roof truss. In the embodiment illustrated, connector 60 as two end portions 62, which are hollow square flange portions identical in dimension to flange 71 of adapter 70, which fits within a post 1 or 28 as shown in FIGS. 13 and 14, and a solid curved cylindrical intermediate portion 61.

Portions 62 can be provided with holes therethrough to enable fastening a post 1 or 28 to a connector 60 with bolts or the like, although this is not absolutely necessary to practice this invention. It should be noted that holes for fastening together with bolts or the like can be provided in any post or adapter or connector of this invention, if desired.

Figure 27:
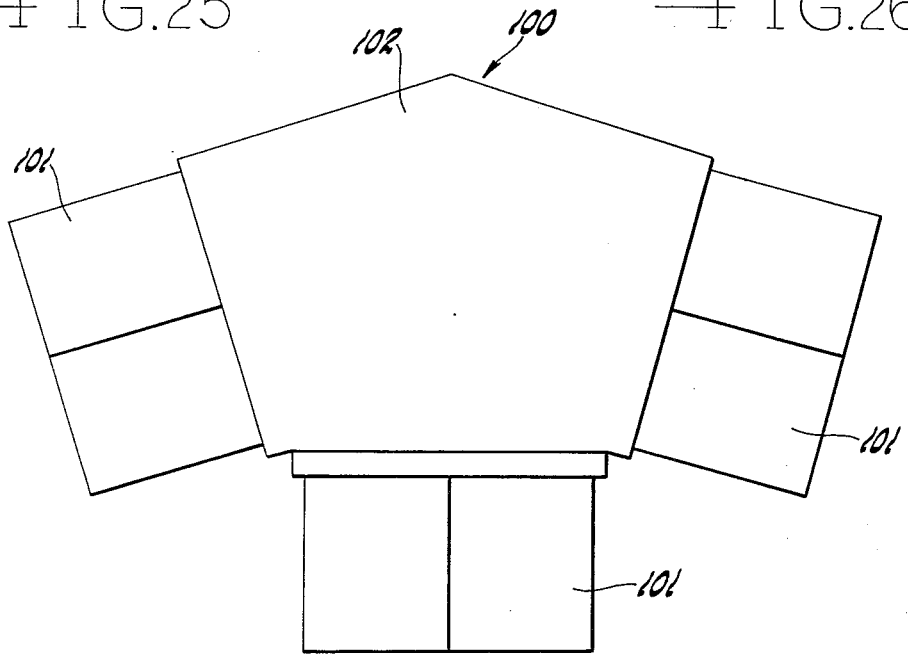
FIG. 27 illustrates a horizontal perspective view of a second embodiment of a connector according to the present invention.
Figure 28:
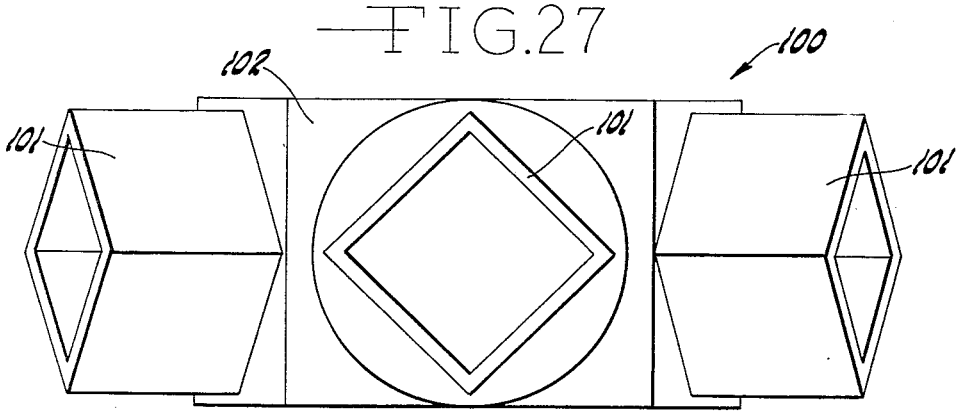
FIG. 28 illustrates a vertical perspective view of a connector according to FIG. 27.

FIGS. 27 and 28 illustrate a connector 100 for joining three posts 1 or 28 according to the invention. In an actual working embodiment of this invention, connector 100 is used to form the peak member of a roof truss. Connector 100 is provided with three end portion flanges 101, identical in dimension to flange 71 of adapter 70, which interconnect with a post 1 or 28 as shown in FIGS. 13 and 14, and a center portion 102, supporting flanges 101 in a predetermined relationship.

In an actual physical embodiment, the angles between the three flanges 101 are multiples of 30 degrees. It is preferred, although not necessary, that each flange 101 be provided with holes to facilitate fastening posts 1 or 28 to connector 100 by means of bolts or the like.

FIGS. 29 and 30 illustrate a third embodiment of a connector according to the present invention. Connector 110 is adapted to connect three posts 1 or 28 together, with an angle of approximately 120° between each post 1 or 28. In an actual working embodiment, connector 110 is used to connect the ends of two roof truss assemblies together to form a double-width structure. Connector 110 has, in this embodiment, a solid center section 112, and three end portion flanges 111, each identical in dimension to flange 71 of adapter 70, which also interconnects with post 1 or 28 as shown in FIGS. 13 and 14. It is apparent that each flange 111 could be provided with holes to facilitate fastening posts 1 or 28 to connectors 110 by the use of bolts or the like, although it should also be apparent that such holes are not necessary to practice this invention.

Figure 31:
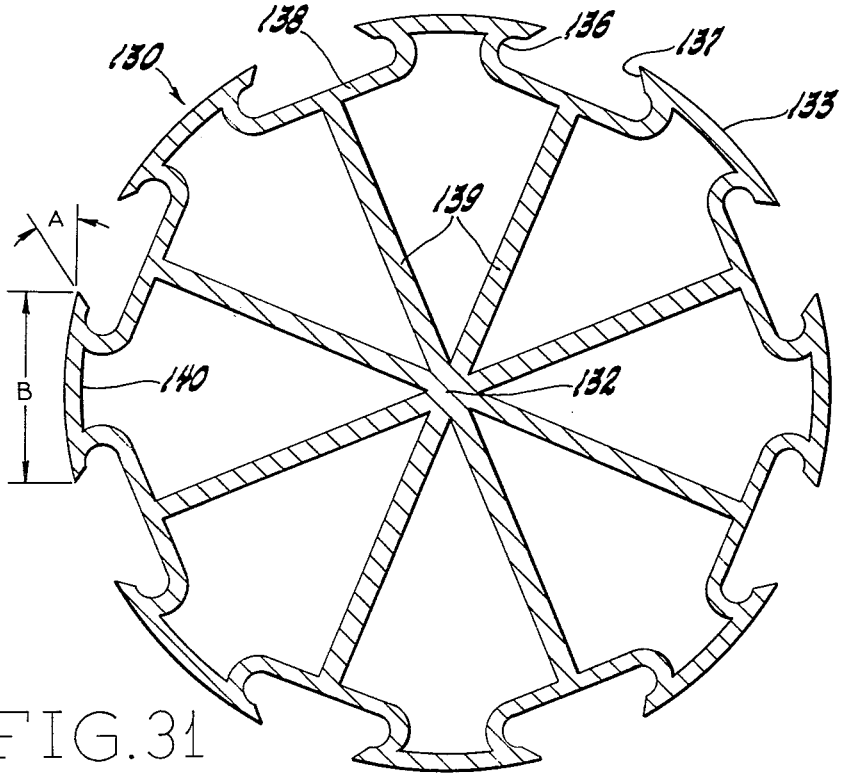
FIG. 31 illustrates a vertical perspective view, in cross-section, of a third possible embodiment of a post according to the instant invention.

FIG. 31 illustrates a third possible embodiment of a post according to the instant invention. Post 130 has a major longitudinal central axis 132 and an outer periphery 133 which includes at least one groove 134. The outer periphery 133 is generally tubular in configuration, with a wall 135 of substantially constant thickness.

Each of the grooves 134 is disposed substantially parallel to the central axis 132. Each groove 134 has an arcuate wall portion 136 and a substantially flat wall portion 137. The wall portion 137 is disposed in a plane which is oriented askew with respect to the axis 132. In other words, flat wall portion 137 is disposed in a plane to one side of the axis 132, and which does not intersect with axis 132. In particular, it should be noted that the first flat wall portion 137 is constructed to be oriented at a predetermined angle A. In a particular working embodiment of the invention the predetermined angle A has been fixed at approximately 30°.

The groove 134 includes a base portion or base 138 which is disposed in a plane that is oriented substantially perpendicular to a radius emanating from axis 132. It should be noted that no surface or wall portion of the groove 134 is disposed substantially perpendicular to the plane within which the base 138 of that groove is disposed. It should also be noted that the arcuate wall portion 136 intersects the first flat wall portion 137 in an oblique dihedral angle.

Wall portion 137 does not intersect the base 138, but rather wall portion 138 is separated from base 138 by the arcuate wall portion 136. Wall portion 137 is disposed in a plane which would intersect base 138 in a similar oblique dihedral angle.

The configuration and dimensions of post 130 are critical to operability and interchangeability of the various components of the present invention. In this connection, attention is directed to the predetermined dimension B of an arcuate wall section 140 forming part of the outer periphery 133 of the post 130. The significance of dimension B of section 140 should be apparent from the explanation set forth above regarding the interchangeability of brackets 11, 30, 40 and 120, which are useable with post 130, as well as with posts 1 and 28. Post 130, unlike posts 1 or 28, has strengthening member portions 139, radially disposed from axis 132 to intersect perpendicularily with bases 138 of grooves 134. Post 130 is adapted for higher stress applications than posts 1 or 28. In the embodiment illustrated, post 130 is capable of being mated with modifications of adapter 70, connectors 60, 100, and 110, points 90 and 120, and cap 80, which have octagonal, rather than square, mating portions. Obviously, members 139 of post 130 must be removed for a short distance from an end of a post 130. This can be accomplished by the use of conventional means, such as a milling machine, or with hand tools such as a sabre saw.

It is to be assumed that one skilled in the art may make numerous changes and modifications in the described embodiments of this invention without departing from the scope of the appended claims.

I claim:

1. An apparatus comprising:

an elongated support member having a major longitudinal central axis and an outer periphery which includes at least one groove therein;

said elongated support member having a tubular configuration which has a substantially constant wall thickness;

said groove being disposed substantially parallel to said major longitudinal central axis of said elongated support member;

said groove having an arcuate side wall portion and a substantially flat side wall portion;

said groove including a flat base portion which is disposed in a flat plane that is oriented substantially perpendicular to a radius emanating from said major longitudinal central axis of said elongated support member; and interconnecting means for assembling at least one said elongated support member into a building structure member.

2. An apparatus according to claim 1, wherein:

said substantially flat side wall portion of said groove is disposed in a flat plane which is oriented askew with respect to said major longitudinal central axis of said elongated support member; and none of said side wall portions of said groove of said elongated support member is disposed perpendicular to said flat plane within which said flat base portion of said groove is disposed.

3. An apparatus according to claim 1, wherein:

said outer periphery of said elongated support member includes at least two said grooves therein; and said elongated support member further comprises a plurality of elongated strengthening members disposed radially from said major longitudinal central axis to said flat base portions.

4. An apparatus according to claim 1, wherein said interconnecting means includes:

at least one connector member for connecting together a plurality of said elongated support members and maintaining a predetermined angular relationship therebetween;

said connector member comprising a body portion and a pluralith of substantially identical prismatic portions disposed thereon;

at least one said prismatic portion being engaged within an end of one said elongated support member; and said prismatic portion having at least one face thereon, said face being disposed contiguous with at least one said flat base portion.

5. An apparatus according to claim 1 or 2, wherein said interconnecting means includes:

an adapter member for connecting said elongated support member to a plane surface, said adapter member further comprising a plate portion and a prismatic portion;

said prismatic portion of said adapter member is engaged within an end of said elongated support member; and said prismatic portion has at least one face thereon, said face being disposed contiguous with at least one said flat base portion.

6. An apparatus according to claim 2, wherein said interconnecting means includes:

a first bracket member for mating with and interconnection with said elongated support member;

said first bracket member having a first arm which is configured and dimensioned to fit within a first said groove of said elongated support member; and said first bracket member having a second arm configured and dimensioned to fit within a second said groove of said elongated support member.

7. An apparatus comprising:

an elongated support member having a major longitudinal central axis and an outer periphery which includes at least one groove therein;

said elongated support member having a tubular configuration which has a substantially constant wall thickness;

said groove being disposed substantially parallel to said major longitudinal central axis of said elongated support member;

said groove having an arcuate side wall portion and a substantially flat side wall portion;

said groove including a flat base portion which is disposed in a flat plane that is oriented substantially perpendicular to a radius emanating from said major longitudinal central axis of said elongated support member;

a point member;

said point member comprising a tapered portion and a prismatic portion;

said prismatic portion being engaged within an end of said elongated support member;

said prismatic portion having at least one face thereon; and said face being disposed contiguous with at least one said flat base portion.

8. An apparatus according to claim 6, wherein:

said tapered portion of said point member is provided with a helical screw member disposed thereon to form an auger.

9. An apparatus according to claim 6, wherein said apparatus further comprises:

a cap member;

said cap member comprising a terminal portion and a prismatic portion;

said prismatic portion being engaged within an end of said elongated support member;

said prismatic portion having at least one face thereon; and said face being disposed contiguous with at least one said flat base portion.

10. A building structural element kit capable of being assembled in the field into building framing members and roof truss members, said members being capable of interconnection to each other, to interconnecting members, to a foundation, and to wall and roof members, the kit comprising:

at least one elongated support member, each said member having a major longitudinal central axis and an outer periphery which includes at least one groove therein;

said elongated support member having a tubular configuration which has substantially constant wall thickness;

said groove being disposed substantially parallel to said major longitudinal central axis of said elongated support member;

said groove having an arcuate side wall portion and a substantially flat side wall portion;

said substantially flat side wall portion of said groove being disposed in a flat plane which is oriented askew with respect to said major longitudinal central axis of said elongated support member;

said groove including a flat base portion which is disposed in a flat plane that is oriented substantially perpendicular to a radius emanating from said major longitudinal central axis of said elongated support member;

none of said side wall portions of said groove of said elongated support member is disposed perpendicular to said flat plane within which said flat base portion of said groove is disposed;

at least one first bracket member adapted to mate with and interconnect with said grooves of said elongated support member, for mounting roof and wall members to said support member;

said first bracket member having a first arm which is configured and dimensioned to fit within a first said groove of said elongated support member;

said first bracket member having a second arm configured and dimensioned to fit within a second said groove of said elongated support member;

said first and second arms of said first bracket member being oriented to converge toward each other;

at least one second bracket member adapted to mate with and interconnect with said elongated support members for connecting intermediate support members to said elongated support members;

said second bracket member having a first portion thereof which is configured and dimensioned to fit within one said groove of said elongated support member;

said first portion of said second bracket member having diametrically-opposed and oppositely-facing arcuate surfaces, each said surface conforming substantially to the shape of said arcuate wall portion of said groove of said elongated support member;

at least two third bracket members for mating with and interconnecting with said elongated support member, said third bracket members being adapted to be used in pairs in adjacent said grooves for connecting one or more intermediate members to said elongated support member;

each of said third bracket members having a portion thereof provided with an arcuate shape which is configured and dimensioned to conform to and fit within said arcuate wall portion of said groove;

at least one adapter member adapted to connect said elongated support members to a plane surface, said adapter member further comprising a plate portion and a prismatic portion;

said prismatic portion of said adapter member being engaged within an end of said elongated support member, and having at least one face thereon, said face being disposed contiguous with at least one said flat base portion;

at least one connector member adapted to connect together a plurality of said elongated support members and maintain a predetermined angular relationship therebetween;

said connector member comprising a body portion and a plurality of substantially identical prismatic portions disposed thereon, at least one said prismatic portion of said connector member being engaged within an end of one said elongated support member; and said prismatic portion of said connector member having at least one face thereon, said face being disposed contiguous with at least one said flat base portion.

* * * * *